US006062014A

United States Patent [19]

Yeh

[11] Patent Number: 6,062,014

[45] Date of Patent: May 16, 2000

[54] STRING FOR A RACKET

[76] Inventor: Yueh-Jui Yeh, No. 151, Jen-Mei Rd., Ho-Mei Chen, Changhua Hsien, Taiwan

[21] Appl. No.: 09/226,206

[22] Filed: Jan. 7, 1999

[51] Int. Cl.[7] ..... D02G 3/36

[52] U.S. Cl. ..... 57/232; 57/234; 57/258

[58] Field of Search ..... 57/232, 234, 258

[56] References Cited

U.S. PATENT DOCUMENTS

| | | | |
|---|---|---|---|
| 4,183,200 | 1/1980 | Bajaj | 57/234 |
| 4,382,358 | 5/1983 | Tappe et al. | 57/243 |
| 4,565,061 | 1/1986 | Durbin | 57/234 |
| 4,660,364 | 4/1987 | Chiang | 57/234 |
| 4,860,531 | 8/1989 | Wells et al. | 57/234 |
| 5,090,188 | 2/1992 | Lin et al. | 57/234 |

*Primary Examiner*—William Stryjewski
*Attorney, Agent, or Firm*—Greenblum & Bernstein, P.L.C.

[57] ABSTRACT

A string for a sports racket includes a core formed of a plurality of core filaments of nylon which are twisted together in a first direction and which are impregnated with a thermoplastic polyurethane resin, a moisture-cured polyurethane layer enclosing the core, a reinforcing layer formed of a plurality of reinforcing nylon filaments which are disposed side by side in annular rows and which are twisted about the polyurethane layer in a second direction opposite to the first direction, and a sheathing layer made of a mixture of silicone and nylon resin and covering the reinforcing layer.

2 Claims, 3 Drawing Sheets

STRING FOR A RACKET

BACKGROUND OF THE INVENTION

1. Field of the Invention

This invention relates to a string for a sports racket, more particularly to a string having a structure that is capable of providing good wear-resistance, elasticity, and mechanical strength to a sport rackets.

2. Description of the Related Art

A known type of conventional racket string is formed of a plurality of core filaments which are twisted together upon passing through an impregnating container carrying a thermoplastic resin inside for impregnating the filaments so as to increase the elasticity of the string. This type of string generally has poor wear-resistance. When the string is used in a racket, high impact and friction induced upon hitting a ball would result in severe wearing of the string.

Another conventional string is formed of a plurality of core filaments sheathed by a moisture-cured polyurethane which provides hardness to increase the wear-resistance of the string. However, this type of string has poor elasticity. Thus, reactive force produced in the string upon impact may injure the user's hand.

SUMMARY OF THE INVENTION

Therefore, it is an object of the present invention to provide a string for a sports racket that has a structure capable of providing good wear-resistance and elasticity.

Accordingly, a string for a racket of the present invention comprises: a core formed of a plurality of core filaments of nylon which are twisted together in a first direction and which are impregnated with a thermoplastic polyurethane resin; a moisture-cured polyurethane layer enclosing the core; a reinforcing layer formed of a plurality of reinforcing nylon filaments which are disposed side by side in annular rows and which are twisted about the polyurethane layer in a second direction opposite to the first direction; and a sheathing layer made of a mixture of silicone and nylon resin and covering the reinforcing layer.

BRIEF DESCRIPTION OF THE DRAWINGS

In drawings which illustrate an embodiment of the invention.

DETAILED DESCRIPTION OF THE PREFERRED EMBODIMENT

Figure 1:
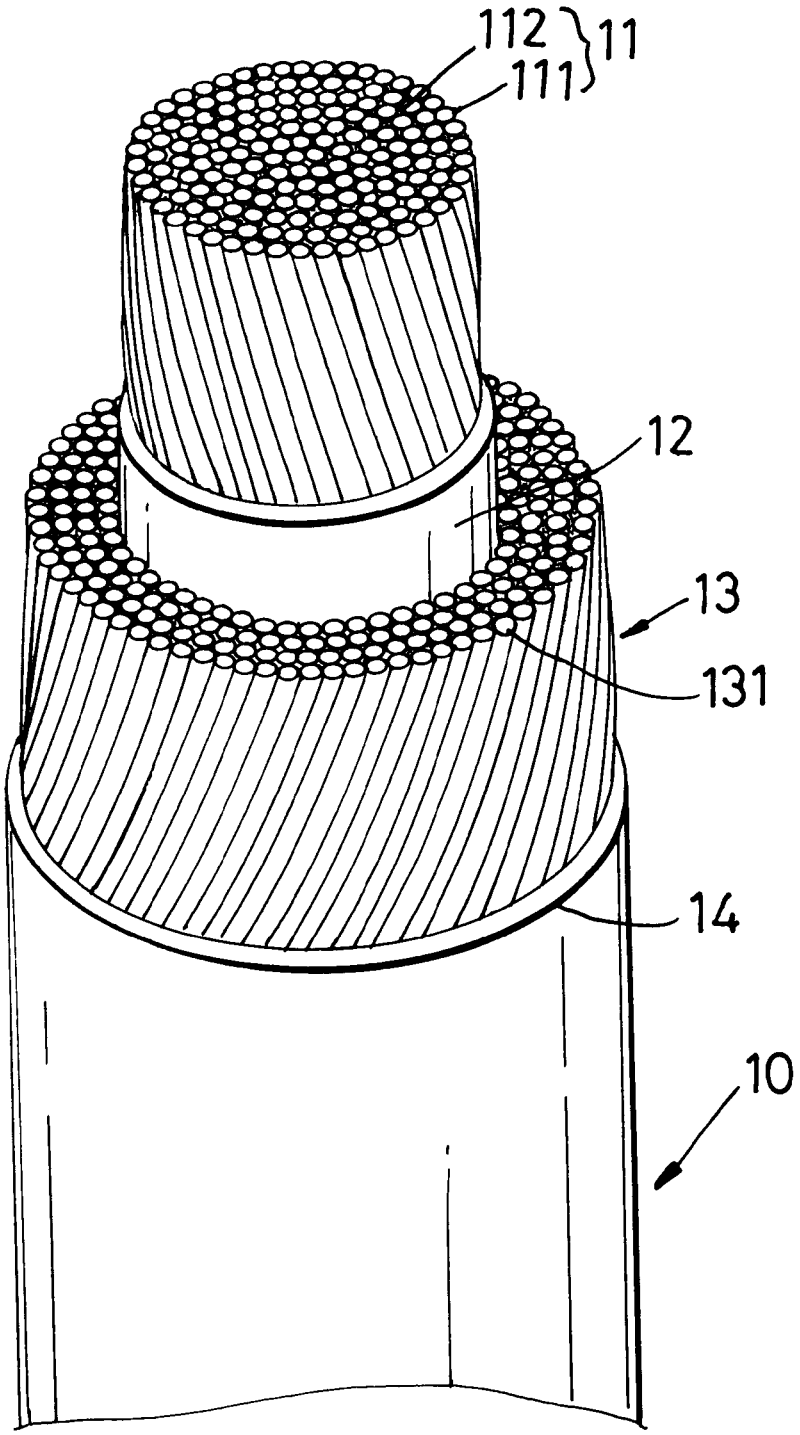
FIG. 1 is a perspective view of a segment of a string embodying the present invention.
Figure 2:
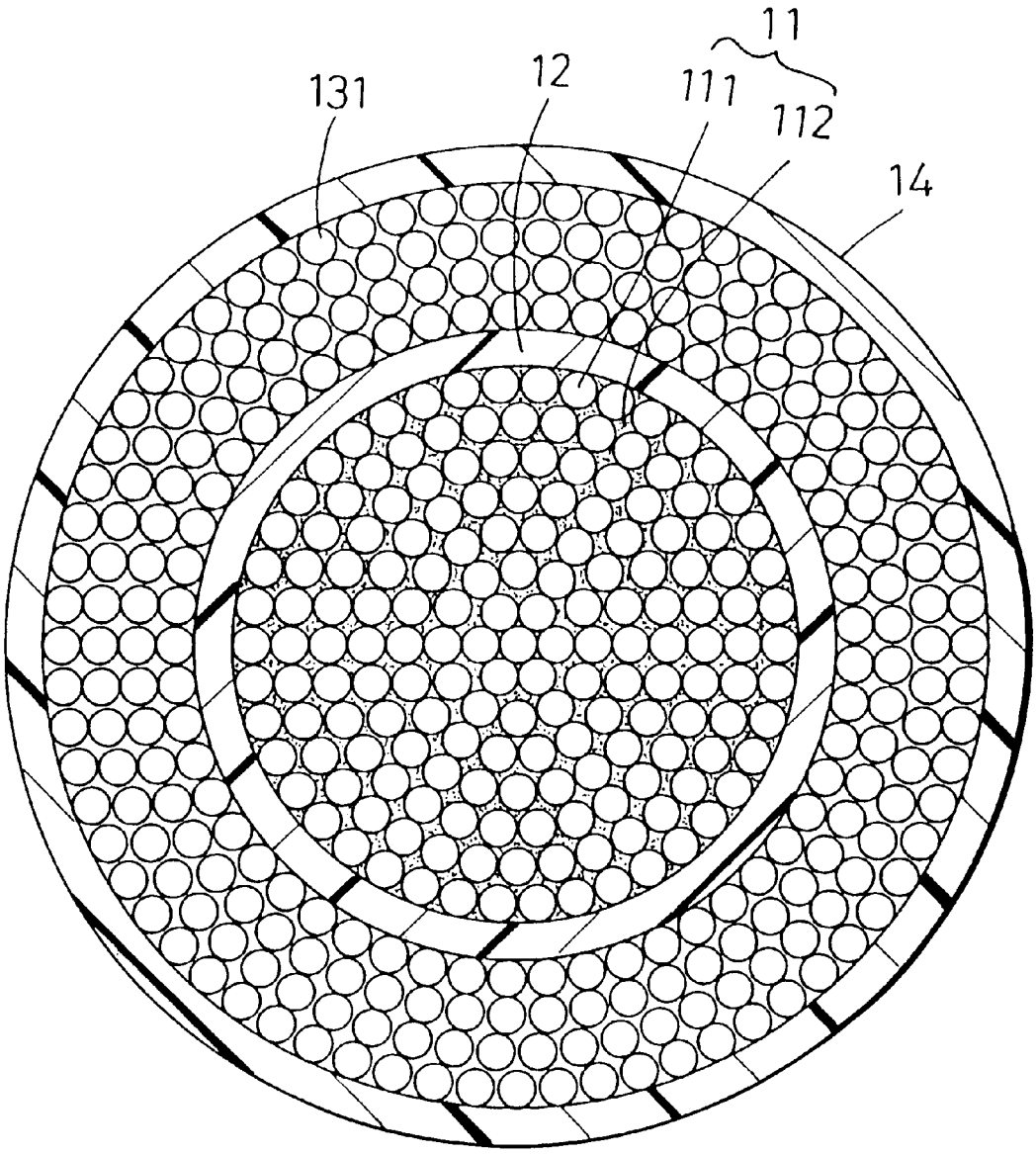
FIG. 2 is a cross-sectional view of the string of FIG. 1.

FIGS. 1 and 2 illustrate a segment of a string 10 embodying this invention. The string 10 shown in FIG. 1 is composed of, from the inside to the outside of the string 10, a core 11, a moisture-cured polyurethane layer 12, a reinforcing layer 13, and a sheathing layer 14. The core 11 is formed of a plurality of core filaments of nylon 111 which are twisted together in a first direction and which are impregnated with a thermoplastic polyurethane resin 112 for bonding the core filaments 111 together to impart elasticity to the core 11.

The moisture-cured polyurethane layer 12 coated on the outer surface of the core 11 provides hardness and good wear-resistance.

The reinforcing layer 13 is formed of a plurality of reinforcing nylon filaments 131 which are disposed side by side in annular rows around the moisture-cured polyurethane layer 12 and which are twisted about the moisture-cured polyurethane layer 12 in a second direction opposite to the first direction so as to increase the engagement between the reinforcing layer 13 and the core 11.

The sheathing layer 14, which covers the reinforcing layer 13, is made of a mixture of silicone and nylon resin. The sheathing layer 14 provides hardness to increase the wear-resistance of the string 10.

The string 10 as described above has a structure that is soft in the inside and hard on the outside which provides the string 10 with good elasticity and wear-resistance, thereby increasing the life of the service string 10 when used in a sports racket.

Figure 3:
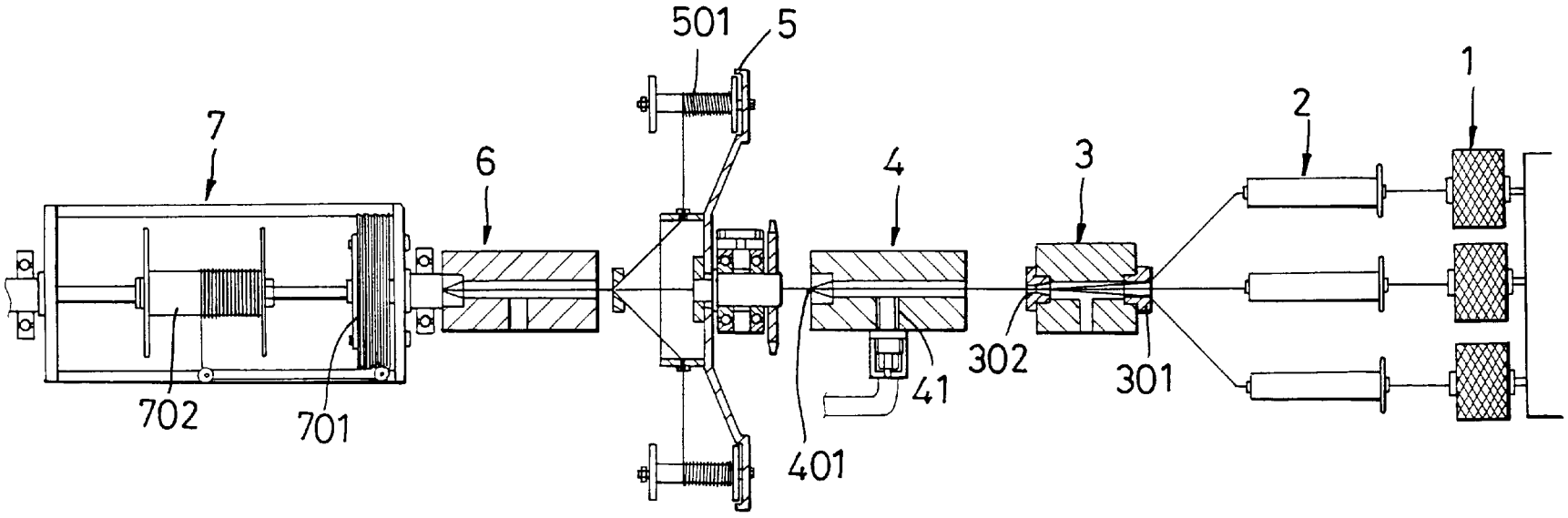
FIG. 3 illustrates a process of making the string of FIG. 1.

The string 10 of this invention is made according to the following steps and means (see FIG. 3):

The core filaments 111 are unwound respectively from a plurality of bobbins 1 and pass through a tension controller 2 for providing the core filaments 111 with the same tension.

The core filaments 111 exiting from the tension controller 2 enter into an impregnating container 3 via a guiding die 301. The impregnating container 3 is filled with a pressurized thermoplastic polyurethane resin 112 so that the core filaments 111 are impregnated by the pressurized thermoplastic polyurethane resin 112. The impregnated core filaments 111 are constricted by a controlling die 302 before exiting to the impregnating container 3, thereby controlling the amount of the thermoplastic polyurethane resin 112 that impregnates the core 11.

The core 11 continuously passes through a polyurethane container 4 for coating the core 11 with a layer of the moisture-cured polyurethane 12. The moisture-cured polyurethane 12 is injected via a passage 41 from one side of the polyurethane container 4. The thickness of the layer of the moisture-cured polyurethane 12 is controlled by a tapering control opening 401.

The core 11 coated with the moisture-cured polyurethane layer 12 is then covered with a plurality of the reinforcing filaments 131 which are respectively unwound from a plurality of bobbins 501 and which are twisted about the polyurethane layer 12 by a rotating disc 5 to form the reinforcing layer 13.

A sheath forming unit 6 is disposed at one side of the rotating disc 5 and receives the core 11 covered with the polyurethane and reinforcing layers 12, 13. A mixture of silicone and nylon resin is supplied to the sheath forming unit 6 and forms the sheathing layer 14 around the reinforcing layer 13, thereby forming the string 10.

The string 10 exiting from the sheathing unit 6 continuously enters a wind-up unit 7. The wind-up unit 7 includes a controlling wheel 701 for controlling the pitch of the winding of the string 10 on a take-up reel 702. Preferably, the direction of the rotation of the controlling wheel 701 is opposite to that of the rotating disc 5 so that good binding among the layers of the string 10 can be achieved.

With the invention thus explained, it is apparent that various modifications and variations can be made without departing from the spirit of the present invention. It is therefore intended that the invention be limited only as recited in the appended claims.

I claim:

1. A string for a racket, comprising:

a core formed of a plurality of core filaments of nylon which are twisted together in a first direction and which are impregnated with a thermoplastic polyurethane resin;

a moisture-cured polyurethane layer enclosing said core;

a reinforcing layer formed of a plurality of reinforced nylon filaments which are disposed side by side in annular rows and which are twisted about said polyurethane layer in a second direction opposite to said first direction; and a sheathing layer made of a mixture of silicone and nylon resin and covering said reinforcing layer.

2. The string of claim 1, wherein said core filaments are impregnated with said thermoplastic polyurethane resin under pressure.

* * * * *